US011084241B2

(12) United States Patent
Winkens et al.

(10) Patent No.: US 11,084,241 B2
(45) Date of Patent: Aug. 10, 2021

(54) DUNNAGE SYSTEM WITH COILER, AUTOMATED TAPING AND EJECTING APPARATUS AND METHOD

(71) Applicant: Ranpak Corp., Concord Township, OH (US)

(72) Inventors: Pedro E Winkens, Vaals (NL); Ad H Veldt, Hoensbroek (NL)

(73) Assignee: Ranpak Corp., Concord Township, OH (US)

( * ) Notice: Subject to any disclaimer, the term of this patent is extended or adjusted under 35 U.S.C. 154(b) by 249 days.

(21) Appl. No.: 16/280,844

(22) Filed: Feb. 20, 2019

(65) Prior Publication Data

US 2019/0176432 A1 Jun. 13, 2019

Related U.S. Application Data

(62) Division of application No. 14/767,047, filed as application No. PCT/US2014/016132 on Feb. 12, 2014, now Pat. No. 10,252,484.

(Continued)

(51) Int. Cl.
*B31D 5/00* (2017.01)
*B65H 18/00* (2006.01)

(Continued)

(52) U.S. Cl.
CPC ..... *B31D 5/0069* (2013.01); *B31D 5/0047* (2013.01); *B65H 18/08* (2013.01);

(Continued)

(58) Field of Classification Search
CPC ..... B31D 5/00; B31D 5/006; B31D 5/0069; B31D 5/004; B31D 5/0047; B65H 18/00;

(Continued)

(56) References Cited

U.S. PATENT DOCUMENTS 2,826,376 A 3/1958 Wallin
3,613,522 A 10/1971 Johnson
4,211,375 A 7/1980 Thievessen et al.

FOREIGN PATENT DOCUMENTS

CN 1190376 A 8/1998
CN 1474908 A 2/2004

(Continued)

OTHER PUBLICATIONS

The International Search Report and the Written Opinion of the International Searching Authority for Corresponding International Application PCT/US2014/016132 dated Apr. 9, 2014.

(Continued)

*Primary Examiner* — Jacob T Minskey
*Assistant Examiner* — Matthew Hoover
(74) *Attorney, Agent, or Firm* — Renner, Otto, Boisselle & Sklar, LLP

(57) ABSTRACT

A dunnage conversion system includes a machine for converting a stock material into a strip of relatively lower-density dunnage, a coiling mechanism for winding the strip into a coil, a taping mechanism for automatically securing a trailing end of the strip to the coil, and a coil ejecting mechanism for automatically removing the coil from the coiling mechanism. The taping mechanism includes a guide surface between an outlet of the machine and the coiling mechanism to guide the strip to the coiling mechanism and to guide tape for engagement with a trailing end of the strip and to secure the trailing end of the strip to the coil. The coil ejecting mechanism includes a lever arm that pivots to push the completed coil off the coiling mechanism.

18 Claims, 6 Drawing Sheets

Related U.S. Application Data

(60) Provisional application No. 61/763,626, filed on Feb. 12, 2013.

(51) Int. Cl.

| | |
|---|---|
| ***B65H 19/00*** | (2006.01) |
| ***B65H 19/29*** | (2006.01) |
| ***B65H 19/30*** | (2006.01) |
| ***B65H 18/08*** | (2006.01) |

(52) U.S. Cl.

CPC ..... *B65H 19/29* (2013.01); *B65H 19/30* (2013.01); *B31D 2205/007* (2013.01); *B31D 2205/0023* (2013.01); *B31D 2205/0047* (2013.01); *B31D 2205/0058* (2013.01); *B31D 2205/0064* (2013.01); *B31D 2205/0082* (2013.01); *B65H 2301/41446* (2013.01); *B65H 2301/418523* (2013.01); *B65H 2402/31* (2013.01); *B65H 2402/33* (2013.01); *B65H 2404/51* (2013.01); *B65H 2515/12* (2013.01); *B65H 2701/177* (2013.01); *B65H 2801/63* (2013.01)

(58) Field of Classification Search

CPC ..... B65H 18/08; B65H 19/00; B65H 19/20; B65H 19/29; B65H 19/30

See application file for complete search history.

(56) References Cited

FOREIGN PATENT DOCUMENTS

| | | | |
|---|---|---|---|
| CN | 1506288 | A | 6/2004 |
| CN | 101039843 | A | 9/2007 |
| CN | 101466626 | A | 6/2009 |
| DE | 2248762 | A1 | 4/1974 |
| DE | 19736497 | A1 | 3/1999 |
| DE | 10330302 | A1 | 2/2005 |
| EP | 1323519 | B1 | 2/2007 |
| GB | 2059388 | B | 4/1983 |
| JP | 07010129 | A | 1/1995 |
| JP | 2001206623 | A | 7/2001 |
| WO | 9921702 | A2 | 5/1999 |
| WO | 2004/041527 | A1 | 5/2004 |
| WO | 2011/086626 | A1 | 7/2011 |

OTHER PUBLICATIONS

The International Preliminary Report on Patentability for Corresponding International Application PCT/US2014/016132.

Chinese Office Action for Application No. 201480008564.8, dated Aug. 1, 2016.

Chinese Office Action for Application No. 201710447828.5, dated Sep. 5, 2018.

DUNNAGE SYSTEM WITH COILER, AUTOMATED TAPING AND EJECTING APPARATUS AND METHOD

This application is a divisional of U.S. application Ser. No. 14/767,047, filed Aug. 11, 2015, which claims priority to International Application No. PCT/US2014/016132, filed Feb. 12, 2014 and published in the English language, and U.S. Provisional Application No. 61/673,626, filed Feb. 12, 2013, which are hereby incorporated herein by reference in their entireties.

FIELD OF THE INVENTION

This invention related generally to a dunnage system and a method for coiling a strip of dunnage, including automatically taping the coil and/or automatically ejecting the coil from the coiler.

BACKGROUND OF THE INVENTION

In the process of shipping one or more articles from one location to another, a packer typically places some type of dunnage material in a shipping container, such as a cardboard box, along with the article or articles to be shipped. The dunnage material partially or completely fills the empty space or void volume around the articles in the container. The dunnage material prevents or minimizes movement of the articles that might be damaged during the shipping process. Some commonly used dunnage materials include plastic airbags and converted paper dunnage material.

To promote continuous operation, many dunnage conversion machines, whether producing airbags or paper dunnage material, output a strip of dunnage that can be cut or severed to provide sections of dunnage of desired lengths. When using the dunnage material to block or brace a relatively large and/or heavy item during shipping, the strip of dunnage may be rolled up in a coil configuration. The coil of dunnage may then be placed in the shipping container beside, above, or below the large/heavy item to be shipped. While coils of cushioning product can be produced by hand, such a procedure can consume a significant amount of time and/or space and manual coiling can lead to inconsistent properties in the coil. Consequently, automated coiling mechanisms have been developed to address one or more of these or other problems.

International Patent Application Publication No. WO 99/21702 describes a system for coiling a strip of cushioning produced by a cushioning conversion machine. A sheet stock material provided from a roll is converted into a strip of relatively lower density cushioning material, which is then wound about a mandrel into a coiled configuration. An automated taping device for securing the trailing end of the strip of cushioning to the coil and an automated coil-ejection device are both suggested in this publication, but the details of such a hypothetical device are neither shown nor described.

SUMMARY OF THE INVENTION

The present invention provides an exemplary automated coil taping device and an exemplary automated dunnage coil-ejection device for use with a dunnage conversion machine and coiler, such as those disclosed in International Publication No. WO 99/21702, referred to above.

More particularly, the present invention provides an automatic taping mechanism for use with a dunnage conversion machine and a coiling mechanism for coiling a strip of dunnage. The taping mechanism includes a supply of tape, and a guide surface that can be positioned between an outlet of the dunnage conversion machine and the coiling mechanism to guide a strip of dunnage to the coiling mechanism. The guide surface also guides a strip of tape for engagement with a trailing end of the strip of dunnage to secure the trailing end of the strip of dunnage to the coil. The guide surface has a groove for receipt of the strip of tape and an inlet opening in the groove for receipt of the strip of tape from the supply of tape, the supply of tape being located on an opposing side of the guide surface opposite the groove.

The taping mechanism may further include a severing mechanism spaced downstream of the tape inlet for separating a length of tape from the supply for attachment to the trailing end of the strip of dunnage.

The taping mechanism may be provided in combination with a coiling mechanism that rotates about an axis to roll the strip of dunnage into a coil. The axis of the coiling mechanism is parallel to the guide surface.

The taping mechanism also may be provided in combination with a dunnage conversion machine that converts a stock material into the strip of dunnage to be coiled. The dunnage conversion machine dispenses the strip of dunnage from an outlet, and the guide surface is mounted between the outlet of the conversion machine and the coiling mechanism.

The taping mechanism may further include a sensor adjacent the tape inlet opening that detects an end of the strip of tape.

The present invention also provides a method of producing a dunnage product, comprising the steps of: (a) providing a strip of dunnage; (b) rolling the strip of dunnage into a coil; and (c) automatically taping a trailing end of the strip of dunnage to an outer surface of the coil.

The providing step (a) may include (i) supplying a sheet stock material, preferably paper, to a dunnage conversion machine; and (ii) converting the sheet stock material into a relatively lower density strip of dunnage.

In addition to the taping mechanism and method, the present invention provides an automatic coil ejecting mechanism for use in a system with a dunnage conversion machine capable of producing a strip of dunnage and dispensing the strip of dunnage through an outlet, and a coiling mechanism downstream of the outlet that is capable of rolling a strip of dunnage about a coil axis to produce a coiled dunnage product. The coil ejecting mechanism includes a lever arm having a pivot axis about which the lever arm is rotatable between a ready position and an ejection position. The ejecting mechanism also has a push plate mounted to the lever arm at a location spaced from the pivot axis. The push plate has a surface that is parallel to a pivot plane that includes the pivot axis, where the pivot plane is perpendicular to the coil axis when the push plate is in the ready position.

The coil ejecting mechanism may further include a support frame to which the lever arm is attached at the pivot axis.

The coil ejecting mechanism also may be provided in combination with a coiling mechanism that rotates about the coil axis to roll the strip of dunnage into a coil, and/or in combination with a dunnage conversion machine that converts a stock material into the strip of dunnage to be coiled, and the lever arm is mounted to a frame that is secured to the conversion machine.

The combination may further include a supply of stock material for conversion into a relatively less dense dunnage product, such as one or more of a sheet of paper and a sheet of kraft paper.

The coil ejecting mechanism may have a coil axis that is generally horizontal and a pivot axis that is generally vertical.

The coil ejecting mechanism may further include a motive device for driving rotation of the lever arm to push a coil off the coiling mechanism. An exemplary motive device includes one or more of an electric motor and a clutch.

The present invention also provides a method of producing a dunnage product that includes the steps of: (a) providing a strip of dunnage; (b) rolling the strip of dunnage on a mandrel about a coil axis into a coil; and (c) automatically ejecting the coil from the mandrel by pushing the coil in a direction generally parallel to the coil axis.

The method may further include a providing step (a) that includes (i) supplying a sheet stock material to a dunnage conversion machine; and (ii) converting the sheet stock material into a strip of relatively lower density dunnage.

Further features of the invention will become apparent from the following detailed description when considered in conjunction with the drawings.

DETAILED DESCRIPTION

Figure 1:
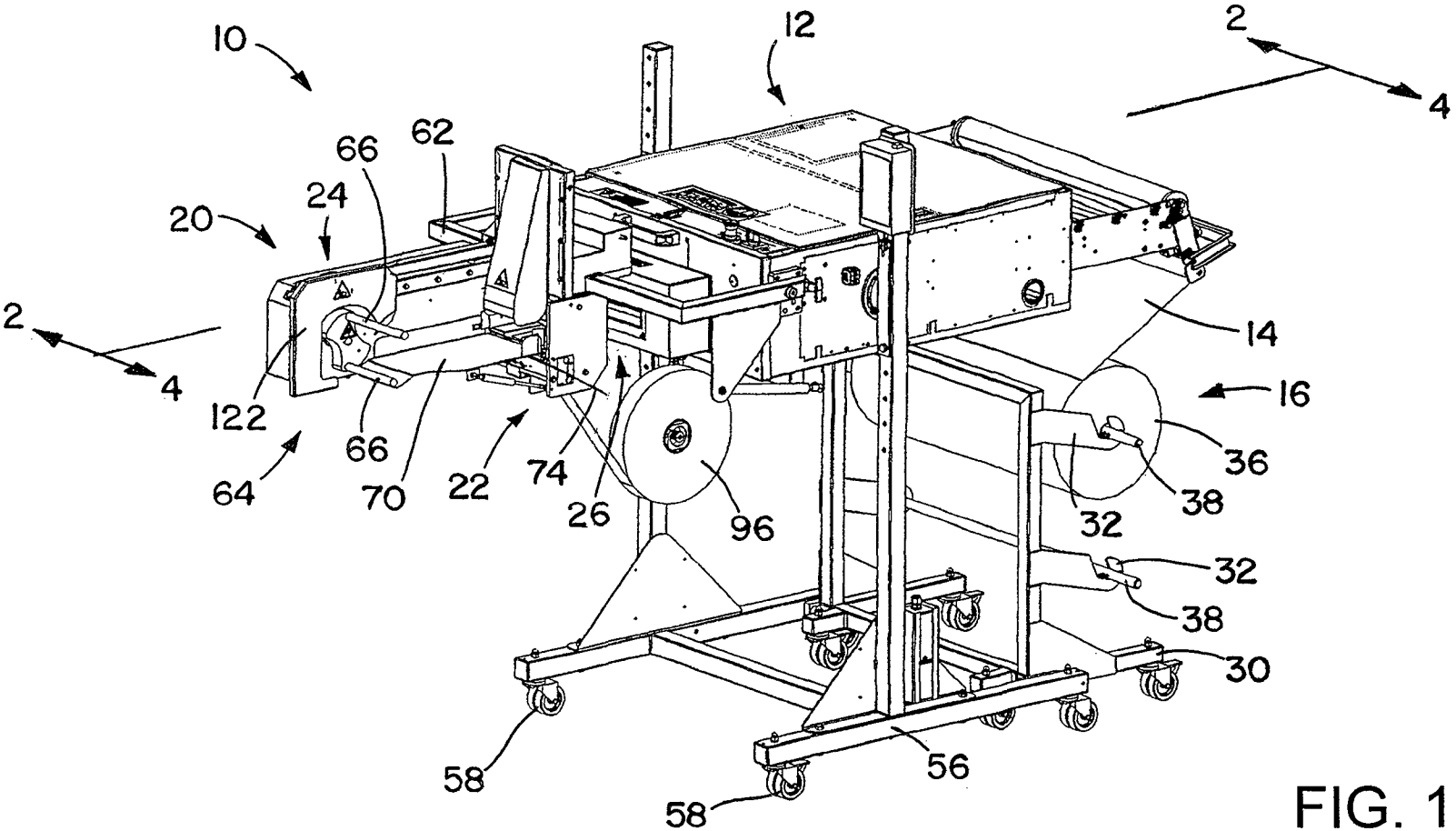
FIG. 1 is a perspective view of a dunnage conversion system employing an automated taping mechanism and a coil ejecting mechanism provided in accordance with the present invention.
Figure 2:
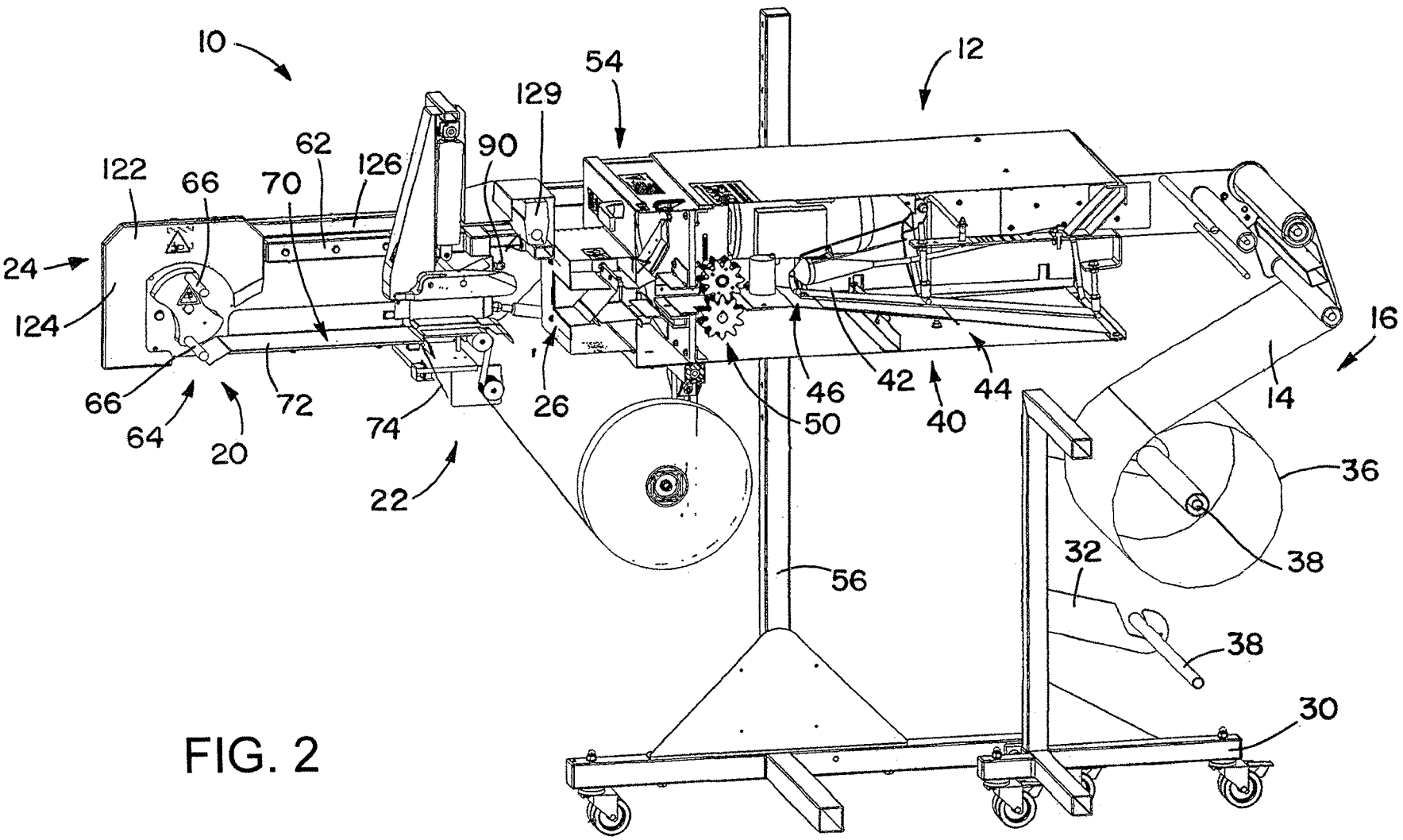
FIG. 2 is a cross-sectional view of the dunnage conversion system of FIG. 1 as seen along lines 2-2.
Figure 3:
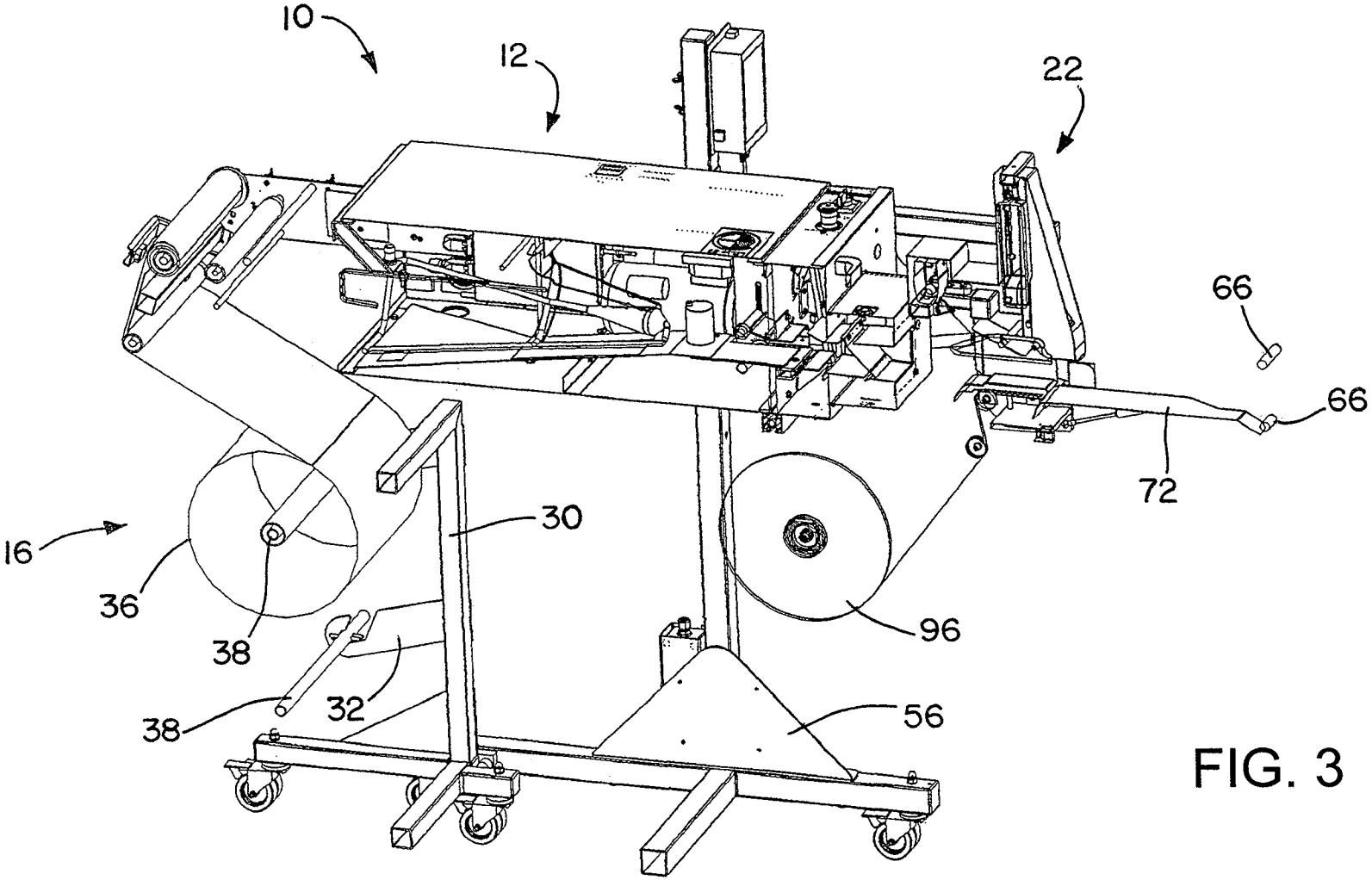
FIG. 3 is a cross-sectional view of the dunnage conversion system of FIG. 1 as seen along lines 3-3, the opposite view as seen in FIG. 2.
Figure 4:
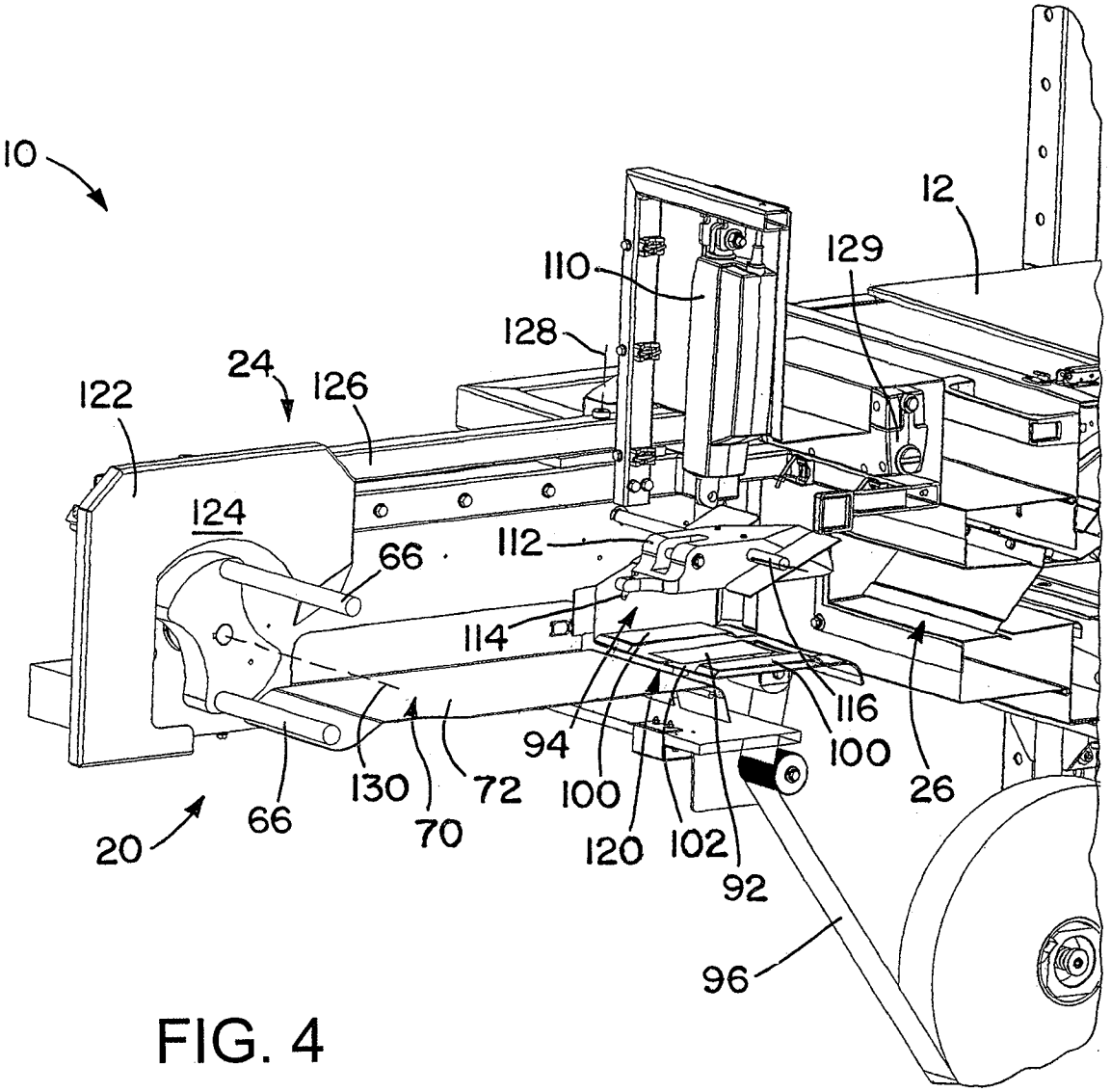
FIG. 4 is an enlarged view of the dunnage conversion system of FIG. 2, and in particular, the automated taping mechanism and the coil ejecting mechanism shown in FIG. 2.
Figure 5:
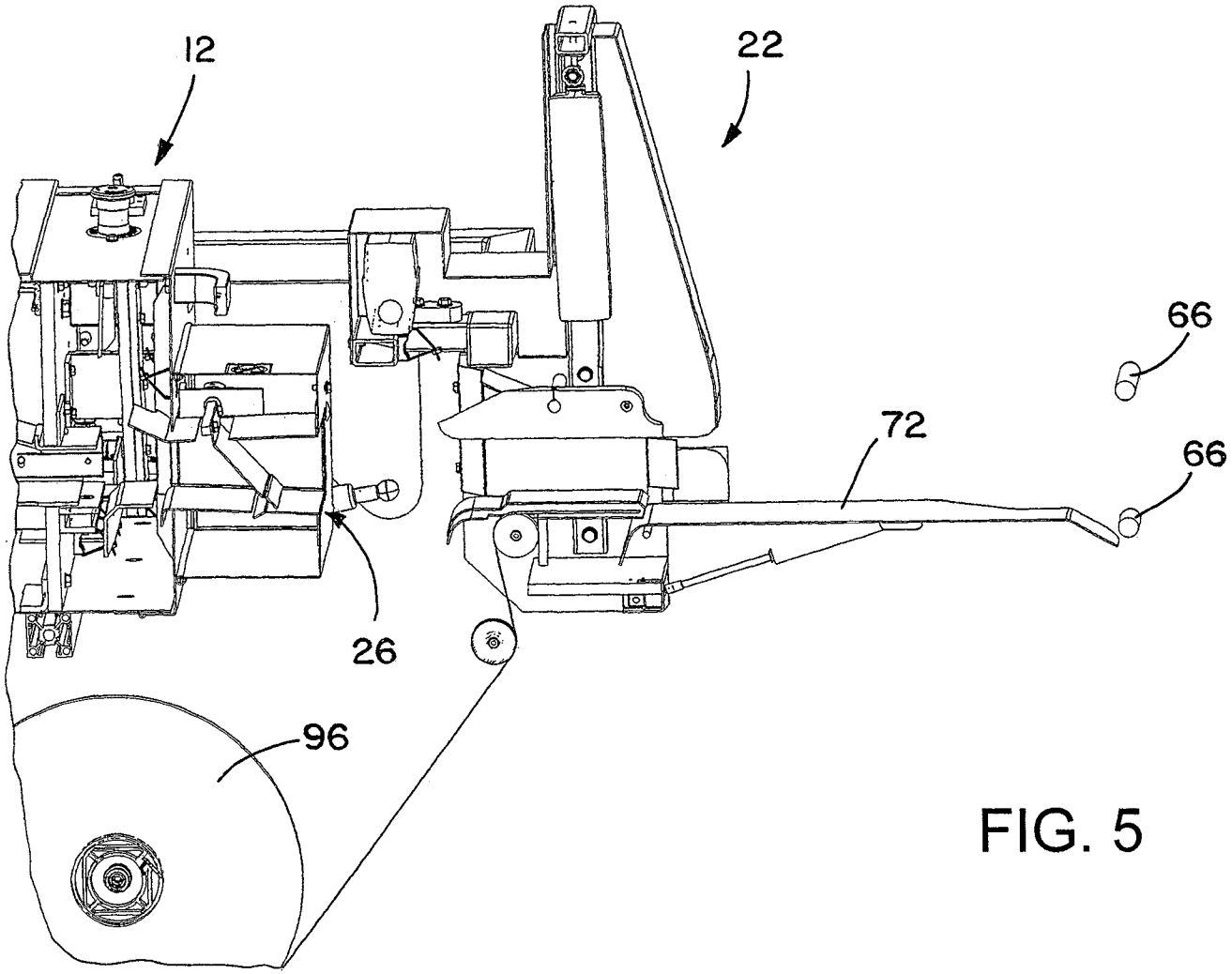
FIG. 5 is an enlarged view of a downstream portion of the dunnage conversion system of FIG. 3, and in particular the automated taping mechanism.
Figure 6:
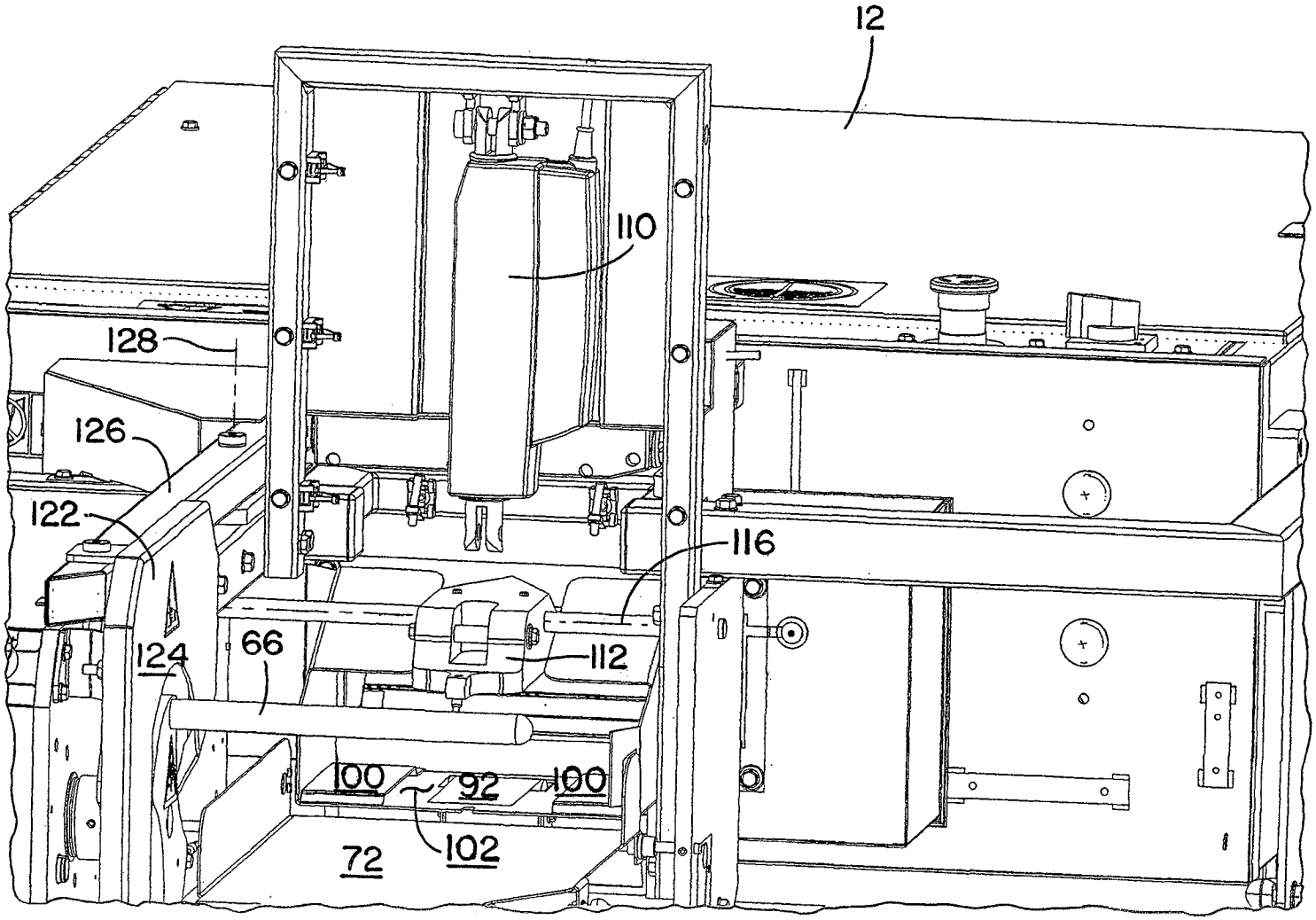
FIG. 6 is an enlarged view of a separating mechanism associated with the automated taping mechanism.

Referring now to the drawings in detail, the present invention provides a dunnage conversion system 10 that includes a dunnage conversion machine 12 (sometimes referred to as a "converter"), a coiling mechanism 20, a taping mechanism 22, and an ejecting mechanism 24. The dunnage conversion machine 12 converts a sheet stock material 14 drawn from a supply 16 into a relatively less dense strip of dunnage (not shown). The strip exits an outlet 26 of the conversion machine 12 and is rolled or wound into a coil by the coiling mechanism 20, and a trailing end of the strip of dunnage is automatically secured to the coil by the taping mechanism 22. The finished coil is automatically ejected from the coiling mechanism 20 by the coil ejecting mechanism 24.

The illustrated supply of stock material 14 includes a mobile cart 30 with one or more pairs of laterally-spaced arms 32 capable of supporting one or more rolls 36 of sheet stock material 14. In this case, only one roll 36 of stock material 14 is shown, supported on the arms 32 by a transverse axle 38, however, a second pair of arms 32 is present and could support a second roll of sheet stock material (not shown) on a corresponding axle 38. An exemplary sheet stock material 14 is kraft paper, and the kraft paper may be supplied wound onto a roll, as shown, or provided in a fan-folded stack.

During the conversion process, the dunnage conversion machine 12 inwardly gathers and crumples the sheet stock material 14 to form a strip of dunnage that is relatively less dense than the sheet stock material 14 from which it is produced. In the illustrated dunnage conversion machine 12, the sheet stock material 14 travels through a forming mechanism 40 that includes a chute 42 that converges in a downstream direction from a chute inlet 44 to a relatively smaller chute outlet 46, inwardly gathering and crumpling the sheet stock material as it passes through the chute 42. The crumpled stock material then passes through a feeding/connecting mechanism 50 downstream of the forming assembly 40 that both feeds the stock material through the conversion machine 12 and connects overlapping layers of sheet stock material to help the finished strip of dunnage maintain its shape. Once a desired length of dunnage has been produced, a separating mechanism 54 downstream of the feeding/connecting mechanism 50 separates the completed dunnage strip from the sheet stock material 14 from the supply 16. The present invention is not limited to the illustrated dunnage conversion machine 12, however, and any dunnage conversion machine that converts a sheet stock material into a length or strip of relatively lower density dunnage may be used in this system 10.

The illustrated dunnage conversion machine 12 is mounted on a stand 56 that has wheels 58 for mobility, however, any type of support for the dunnage conversion machine 12 may be provided, as may be necessary to support the conversion machine 12 and the coiling mechanism 20 at a sufficient elevation to produce a coil.

The coiling mechanism 20, sometimes referred to as a coiler, lies downstream of the dunnage conversion machine 12 and is supported by a frame extension 62 mounted to the frame of the dunnage conversion machine 12 or to the stand 56. The illustrated coiler 20 includes a mandrel about which the strip of dunnage is wound. In the illustrated embodiment, the coiler 20 includes a rotatable fork 64 with a pair of substantially parallel tines 66 between which a leading end of the strip of dunnage is received. Once a leading end of a strip of dunnage passes between the tines 66 of the fork 64, the fork 64 can rotate to wind the strip of dunnage into a coil as the dunnage strip is produced. The strip of dunnage is produced at a constant rate, but the rotation rate of the fork 64 can be varied as a function of the size of the coil to vary the density, consistency, and other properties of the coil.

A guide surface 70 extends from the outlet 26 of the dunnage conversion machine 12 toward the coiling mechanism 20 to guide a strip of dunnage from the outlet 26 to the coiling fork 64. A spring-biased portion 72 of the guide surface adjacent the coiling fork 64 is spring-biased and rotates about an axis 74 spaced from the coiling fork 64 in a direction away from the coiling fork 64 as the coil grows and expands outward. Further reference to an exemplary dunnage conversion machine and coiler can be had with reference to International Publication No. WO 99/21702, referred to above. Alternative coiler designs also could be used in this system 10; the system 10 provided by the invention is not limited to the illustrated coiler 20.

Once a desired length of dunnage has been produced, the separating mechanism 54 in the dunnage conversion machine 12 will sever the strip of dunnage from the remaining stock material. The coiling fork 64 will stop and then continue to rotate to draw the trailing edge of the dunnage strip to the coil. In the past, tape was manually applied to the trailing end of the strip of dunnage to secure the trailing end to the coil so that the coil would maintain its shape. This required an operator to handle the sticky tape, which was inconvenient for the operator, led to errors, inconsistent use of tape, and waste.

To address these and other problems, the dunnage conversion system 10 provided by the invention includes an automated taping mechanism 22. The converter 12 will signal the coiling fork 64 to stop and start based on the status of its feeding/connecting mechanism 50. Specifically, the converter 12 will stop its feeding/connecting mechanism 50 and the coiling fork 64 before activating the separating mechanism 54. After the separating mechanism 54 has separated the dunnage strip from the stock material connected to the supply, the coiling fork 64 is restarted. The automated taping mechanism 22 also includes a separating mechanism, such as the illustrated punch element 114. The punch element 114 breaks a portion of the tape without using a sharpened cutting edge. The other side of punch 94, part of the pivoting body 112, also is used to press the trailing end of the dunnage strip into engagement with an adhesive surface of the tape 92. Once a desired length of tape has advanced to secure the trailing end of the strip to an outer surface of the coil, the punch element 114 can separate a length of tape 92 from a tape supply 96 by perforating the tape 92 by itself.

The tape supply 96 is mounted underneath the conversion machine 12 and tape 92 is drawn into the slot 102 from the supply 96, and fed over an end of the guide surface 70 or through an opening 104 in the guide surface 70 in the manner shown in the illustrated embodiment, for example. To minimize friction between the strip of dunnage exiting the dunnage conversion machine 12 and the adhesive surface of the tape 92, where the guide surface forms part of the taping mechanism 22, a tape-guiding portion of the guide surface 70 has lateral portions 100 that are elevated above a central portion, which forms a groove or slot 102. The leading end of the tape 92 rests in this slot 102, adhesive-side up. The arrival of the trailing end of the strip of dunnage, signaled by the conversion machine 12, causes the other side of the punch 94 on the pivoting body 112 to advance and press the trailing end of the strip into engagement with the adhesive surface. Then the coiler fork 64 will resume winding the strip of dunnage into a coil, and pull the tape 92 from the taping mechanism 96. The tape 92 is wound around the produced coil and maintains the strip of dunnage in the coiled condition.

The punch 94 includes a solenoid 110 or other motive device connected to a pivoting body 112 from which a punch element 114 extends at a point spaced from a pivot axis 116. As the solenoid 110 extends and drives the punch element 114 downward, the leading end of the punch element 114 and the pivoting body will separate the tape 92.

A length of tape will be drawn after the trailing end of the strip of dunnage After the tape 92 has been successfully wound around the coiled strip, the punch 94 advances and punctures the tape 92 and the punch element 114 is received in an opening 120 in the guide surface 70. The punch element 114 punches a hole in the tape 92, thereby weakening the tape 92 so that it will tear automatically as the tape 92 is pulled along by the trailing end of the strip of dunnage. The tension on the axis of the tape supply 96 can be adjusted to facilitate tearing without causing the tape to tear prematurely.

As the trailing end of the strip of dunnage is wound onto the coil, the spring-biased portion of the guide surface 70 will press the tape 92 onto the adjacent surface of the coil to secure the trailing end of the dunnage strip to the coil so that the coil will retain its shape. The taped coil is thus complete and ready for use.

The coil ejecting mechanism 24 then pushes the completed coil off the fork 64. The ejecting mechanism 24 includes an ejector plate 122 adjacent the coiling fork 64 that presents a relatively large surface area to the coil to engage and push the coil off the coiling fork 64. The surface of the ejector plate 122 facing the coiling fork 64 is shaped to allow it to pass the coiling tines 66 as it pushes the coil off the fork 64. This push surface 124 is attached to a lever arm 126 that has a pivot axis 128 generally transverse the coil axis 130 about which the coiling fork 64 rotates. The pivot axis 128 is spaced from the coiling fork 64, approximately adjacent the outlet 26 of the conversion machine 12, and another solenoid or other motive device 129 acts on the lever arm 126 on one side of the pivot axis 128 to pivot the push surface 124, on another side of the pivot axis 128, toward a distal end of the coiling fork tines 66 to slide the coiled strip of dunnage off the tines 66 of the fork 64. The lever arm 126 and ejector plate 122 pivotably move between a ready position that allows the coiler 20 to produce a coiled strip of dunnage and an ejection position that pushes the coil off the end of the tines 66 of the fork 64 in a direction generally parallel to the coil axis 130. An operator can then place the coiled strip of dunnage into a box or other container for packing purposes.

The system provided by the present invention thus improves upon prior systems that wound strips of dunnage into a coil, by providing an automated taping mechanism for applying tape to a trailing end of the strip of dunnage to adhere the trailing end of the strip to the coil, thereby holding the strip of dunnage in the coiled configuration. The present invention further improves upon prior systems by providing an automated coil ejection mechanism for removing the coiled strip of dunnage from the coiling mechanism, using a pivotably-mounted push plate to leverage the coiled dunnage off the coiling mechanism. This system allows the packer or other operator to concentrate on packaging items in a container rather than applying tape and removing coils of dunnage. This increases the efficiency of a packaging operation that uses a coiling mechanism and reduces waste. In summary, the present invention provides a dunnage conversion system 10 that includes a machine 12 for converting a stock material 14 into a strip of relatively lower-density dunnage, a coiling mechanism 20 for winding the strip into a coil, a taping mechanism 22 for automatically securing a trailing end of the strip to the coil, and a coil ejecting mechanism 24 for automatically removing the coil from the coiling mechanism 20. The taping mechanism 22 includes a guide surface 70 between an outlet 26 of the machine 12 and the coiling mechanism 20 to guide the strip to the coiling mechanism 20 and to guide tape 92 for engagement with a trailing end of the strip and to secure the trailing end of the strip to the coil. The coil ejecting mechanism 24 includes a lever arm 126 that pivots to push the completed coil off the coiling mechanism 20.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of producing a dunnage product, comprising the steps of:

providing a strip of dunnage;

rolling the strip of dunnage into a coil; and automatically taping a trailing end of the strip of dunnage to an outer surface of the coil.

2. A method as set forth in claim 1, where the providing step includes supplying a sheet stock material, preferably paper, to a dunnage conversion machine; and converting the sheet stock material into a relatively lower density strip of dunnage.

3. A method as set forth in claim 2, where the stock material includes one or more of a sheet of paper and a sheet of kraft paper.

4. A method as set forth in claim 2, where the providing step further includes dispensing the strip of dunnage from the dunnage conversion machine.

5. A method as set forth in claim 2, where the providing step further includes separating the strip of dunnage from the stock material.

6. A method as set forth in claim 5, where the rolling step is temporarily stopped before the occurrence of the separating step.

7. A method as set forth in claim 5, where the rolling step restarts after the occurrence of the separating step.

8. A method as set forth in claim 1, where the providing step includes passing a leading end of the strip of dunnage between tines of a fork of a coiler.

9. A method as set forth in claim 8, where the rolling step begins after the leading end of the strip of dunnage passes between the tines of a fork of a coiler.

10. A method as set forth in claim 1, where the rolling step includes rotating a fork of a coiler to wind the strip of dunnage into the coil.

11. A method as set forth in claim 10, where the rolling step further includes controlling a speed of the fork as a function of a speed of the strip of dunnage being fed to the coiler and a desired size of the coil.

12. A method as set forth in claim 1, where the method further includes detecting the trailing end of the strip of dunnage.

13. A method as set forth in claim 12, where the taping step begins after the trailing end of the strip of dunnage is detected.

14. A method as set forth in claim 1, where the taping step includes pressing the trailing end of the strip of dunnage into engagement with a leading end of tape from a tape supply.

15. A method as set forth in claim 14, where the taping step further includes pulling tape from the tape supply by continuing to roll the strip of dunnage into the coil.

16. A method as set forth in claim 1, where the taping step includes winding tape around the coil as the strip of dunnage is rolled into the coil.

17. A method as set forth in claim 1, where the taping step includes severing tape from a tape supply.

18. A method as set forth in claim 17, where the severing step includes punching a hole in the tape to weaken the tape so that it automatically tears as the tape is pulled along by the trailing end of the strip of dunnage.

* * * * *